US006431971B2

(12) United States Patent
Nagafuchi

(10) Patent No.: US 6,431,971 B2
(45) Date of Patent: Aug. 13, 2002

(54) ABRASIVE BRUSH

(75) Inventor: Naohiro Nagafuchi, Sagamihara (JP)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/478,044

(22) Filed: Jan. 5, 2000

(30) Foreign Application Priority Data

Jan. 8, 1999 (JP) ..... 11-002551

(51) Int. Cl.[7] ..... B24B 9/02

(52) U.S. Cl. ..... 451/496; 451/498; 451/508; 451/464; 29/81.12

(58) Field of Search ..... 451/496, 498, 451/508, 548, 550, 532, 533, 497, 464, 468, 490, 415; 29/81.12

(56) References Cited

U.S. PATENT DOCUMENTS

| | | | | |
|---|---|---|---|---|
| 2,720,064 A | * | 10/1955 | Klug | 451/497 |
| 2,811,816 A | * | 11/1957 | Back | 451/496 |
| 4,872,292 A | * | 10/1989 | Block | 451/533 |
| 5,016,311 A | * | 5/1991 | Young et al. | 451/496 |
| 5,427,595 A | | 6/1995 | Pihl et al. | 51/298 |
| 5,443,906 A | | 8/1995 | Pihl et al. | 428/370 |
| 5,460,883 A | | 10/1995 | Barber, Jr. et al. | 428/370 |
| 5,491,025 A | | 2/1996 | Pihl et al. | 428/373 |
| 5,518,794 A | | 5/1996 | Barber, Jr. et al. | 428/95 |
| 5,554,068 A | * | 9/1996 | Carr et al. | 451/532 |
| 5,571,296 A | | 11/1996 | Barber, Jr. et al. | 51/295 |
| 5,588,172 A | * | 12/1996 | Biocca | 451/496 |
| 5,616,411 A | | 4/1997 | Barber, Jr. et al. | 428/373 |
| 5,679,067 A | | 10/1997 | Johnson et al. | 451/527 |
| 5,737,794 A | | 4/1998 | Barber, Jr. et al. | 15/229.12 |
| 5,837,179 A | | 11/1998 | Pihl et al. | 264/172.11 |
| 5,849,052 A | | 12/1998 | Barber, Jr. | 51/298 |
| 5,903,951 A | | 5/1999 | Ionta et al. | 15/180 |
| 5,915,436 A | | 6/1999 | Johnson et al. | 15/187 |
| 5,964,006 A | | 10/1999 | Holmes et al. | 15/180 |
| 5,983,434 A | | 11/1999 | Eichinger et al. | 15/180 |

FOREIGN PATENT DOCUMENTS

| | | | |
|---|---|---|---|
| JP | 8-25229 | 1/1996 | B24D/13/08 |
| JP | 9-201232 | 8/1997 | A46B/7/10 |

OTHER PUBLICATIONS

Johnson et al., U.S. application Ser. No. 08/953,172, "Molded Abrasive Brush", filed Oct. 17, 1997.

Holmes et al., U.S. application Ser. No. 09/386,999, "Rotary Surface Treatment Tool", filed Aug. 31, 1999.

Lageson et al., U.S. application Ser. No. 09/419,253, "An Integrally–Molded Brush and Method for Making the Same", filed Oct. 15, 1999.

* cited by examiner

*Primary Examiner*—Eileen P. Morgan
(74) *Attorney, Agent, or Firm*—Gregory D. Allen

(57) ABSTRACT

This invention provides an abrasive brush having strength and abrasive characteristics similar or superior to those of conventional brushes, and which allows a brush assembly having a desired width dimension and a desired brush surface hardness to be readily and easily assembled. A disk-shaped abrasive brush 1 includes a radial inner hub 5 and a radial outer brush section 3, preferably the hub 5 being integrally formed with the brush section 3. The hub 5 is provided with a flat part, a recessed part 9, 11, and a projecting part 7. When two adjacent abrasive brushes are aligned adjacent to each other, the flat, recessed and projecting parts of the abrasive brushes are engaged with each other and define a pitch between the abrasive brushes.

17 Claims, 5 Drawing Sheets

ABRASIVE BRUSH

The present invention relates to an abrasive brush, and particularly to a roll-shaped laminated abrasive brush.

Conventional laminated abrasive brushes made of non-woven abrasive sheets compressed or packed on a shaft typically lack mechanical strength and often have a tendency to slip when the shaft is rotated. Attempts to eliminate these problems associated with such laminated abrasive brushes have been reported in Japanese Patent Publication Nos. (Kokai) 8-25229 and 9-201232.

Kokai Publication 8-25229 discloses a holder for an abrasive disk tool. A plurality of disk-shaped sheet members, each composed solely of abrasive material, are aligned next to each other and secured, in a compressed state, to each other by snap-fit type fasteners. To optimize the axially compressed state and regulate the density of the abrasive material (disk-shaped sheet members), a separate spacer is placed or interposed between adjacent disk-shaped sheet members.

Kokai Publication 9-201232 discloses an abrasive brush having disk-shaped sheet members composed of abrasive material that are aligned next to each other and compressed together to form a laminated roll brush with a jig, and then adhesive impregnated in the sheet members is cured to maintain a laminated roll shape. The laminated brush is mounted on a spindle of a rotating device via a center through-hole.

The device reported in Kokia 8-25229 has a problem in that the dimensions (lengths) of the snap-fit type fasteners determine an overall width of the resultant brush. In addition, when a brush assembly of a highly compressed type is manufactured using intervening spacers, there is a further problem in that a specialized device or tool is necessary for the assembly of the brush, resulting in difficult assembly at a job site.

In order to manufacture the brush reported in Kokai Publication 9-201232, a large installation is required for curing the adhesive, which cure is unsuitable for being carried out at a job site, and therefore the assembly of this type of brush (assembly) is generally carried out in a specialized facility. Also, it may be difficult to obtain a desired brush surface hardness by the curing of the adhesive.

The present invention provides a reasonable and economical abrasive brush having a strength and abrasive characteristic similar or superior to those of conventional brushes, and which allows a brush assembly having a desired width dimension and a desired brush surface hardness to be readily and easily manufactured.

SUMMARY OF THE INVENTION

The present invention provides a disk-shaped abrasive brush that may be combined to form a roll-shaped brush. This abrasive brush includes a hub and a radial outer brush section, the hub being integrally formed with the brush section, characterized in that the hub comprises a flat part, a recessed part and a projecting part. At least one of the flat, recessed and projecting parts of one abrasive brush is engaged with at least one of the flat, recessed and projecting parts of another adjacent abrasive brush in order to define a pitch between the two abrasive brushes.

It is preferred that the projecting part of one abrasive brush is engaged respectively with the flat, recessed and projecting parts of another abrasive brush in order to define mutually different pitches between the abrasive brushes.

It is also preferred that the hub is formed through injection molding a predetermined plastic or resin, wherein at least an inner periphery of the brush section is formed from a material having numbers of openings, to permit molten resin for the injection molding of the hub to flow into the openings, and wherein the hub is integrally formed with the brush section, in such a manner that a radial inner portion of an abrasive material penetrates into an outer peripheral side surface of the hub, and that the molten resin for the injection molding of the hub flows into and is solidified within the openings of the penetrated radial inner portion of the brush section.

BRIEF DESCRIPTION OF THE DRAWINGS

Preferred embodiments of the present invention will be described below with reference to the attached drawings. FIGS. 1 to 4 illustrate a first embodiment of an abrasive brush 1. FIGS. 5 to 7 illustrate a second embodiment of an abrasive brush 21.

In FIG. 1, the abrasive brush 1 includes a radial outer brush section 3 of a doughnut-shaped plate and a radial hub 5 in a shape of a small disk.

The brush section 3 is formed of a non-woven abrasive material made of polyester or polyamide fibers having a thickness, for example, in a range from 5 to 50 denier.

The hub 5 is formed of a plastic or resin material such as ABS, polyamide, polyester or others, for example, by an injection molding process, but of course is not limited thereto, provided a predetermined strength and a proper bonding of the brush section to the hub is obtainable.

The brush section 3 and the hub 5 are integrally coupled with each other by the adhesion obtained by the use of a predetermined adhesive or by a bonding force generated when a molten plastic or resin is solidified after flowing into fibrous interstices or voids in material of the brush section 3 during the injection molding of the hub 5.

The brush section 3 (abrasive material) may be formed of any material other than the non-woven fabric provided it has the material interstices having a characteristic satisfying the above-mentioned requisites, such as a sand paper, a woven fabric or a grindstone (stone+adhesive).

Figures 2A, 2B, 2C:
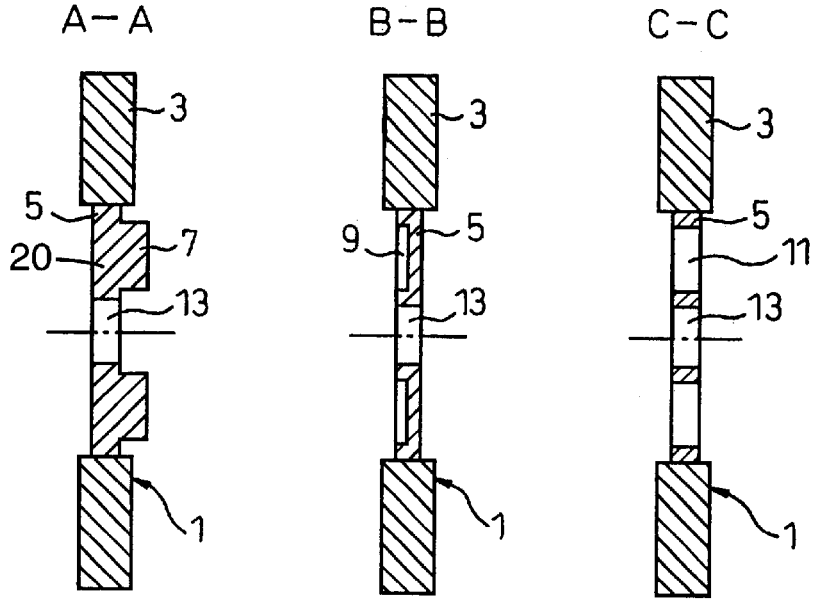
FIGS. 2(*a–c*) are cross-sectional views of the abrasive brush of FIG. 1 taken along section lines A—A, B—B, and C—C.
Figure 3:
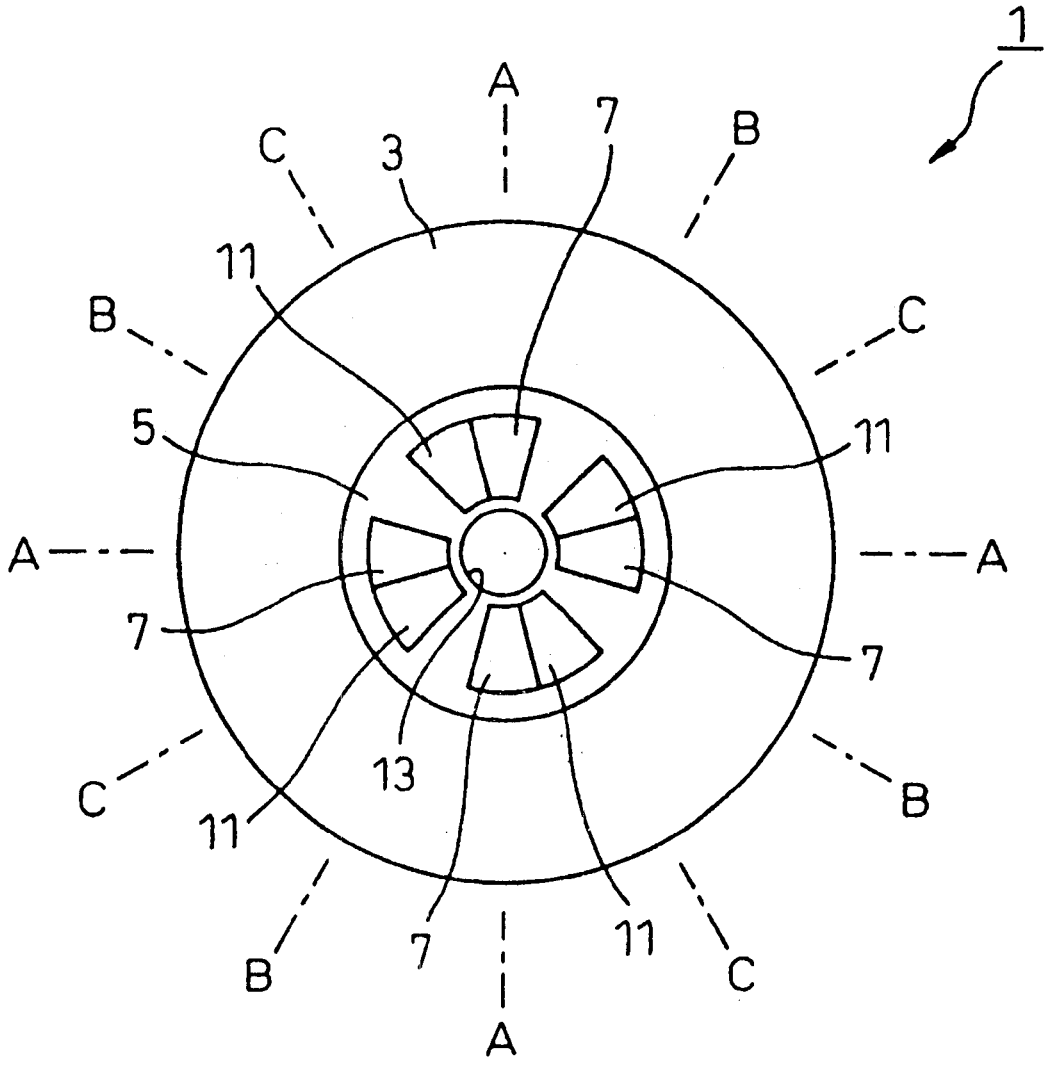
FIG. 3 is a plan view of another face of the abrasive brush of FIG. 1.

The hub 5 of the abrasive brush 1 has a basic thickness, for example, approximately equal to half of the thickness of the brush section 3 (radial outer abrasive material brush section) and is provided with a projecting part 7, a recessed part 9 and a through-hole part 11. That is, in each of two cross-sections A—A of the hub 5, a projecting part 7 (FIG. 2(*a*)) extending parallel to the axial direction is provided on one side of the hub. Namely, four projecting parts 7 are equi-distantly arranged at four positions on a predetermined diametrical circle on one side or face of the hub (see FIG. 3).

Similarly, in each of two cross-sections B—B of the hub 5, a recess part 9 having a depth approximately equal to half of the projected height of the projecting part 7 is provided. That is, four recesses 9 are equi-distantly arranged at four positions on a predetermined diametrical circle on a side or face of the hub that has no projections 7 present.

Also, similarly, in each of two cross-sections C—C of the hub 5, a through-hole part 11 of a shape complementary to that of the projecting part (i.e., smoothly engageable with the projecting part 7) is provided. That is, four through-hole parts 11 are equi-distantly arranged at four positions on a predetermined diametrical circle.

An attachment hole 13 is provided in the center of the hub for mounting the brush onto a rotary shaft of a tool such as a grinder, not shown.

An abrasive brush assembly of a wider width is assembled from a plurality of the abrasive brushes 1 of the above-mentioned structure.

Figure 1:
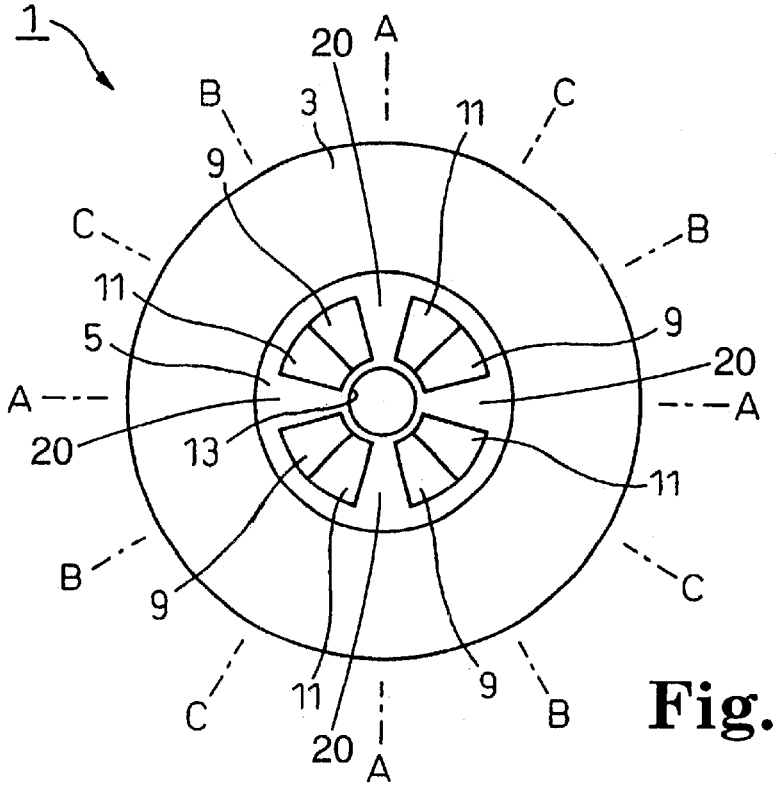
FIG. 1 is a plan view of one face of an abrasive brush of the present invention.
Figure 4C:
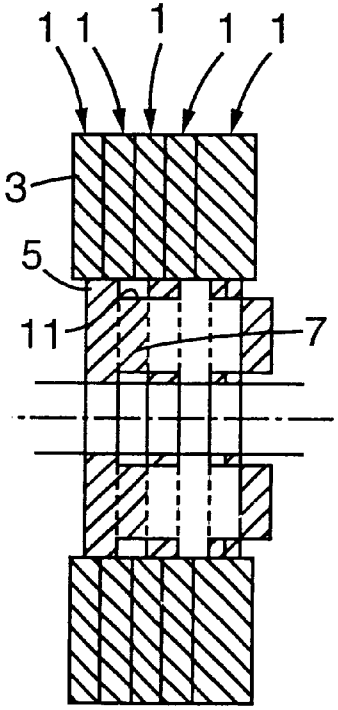
FIGS. 4(*a–c*) are illustrations of five abrasive brushes of the present invention.
Figure 4B:
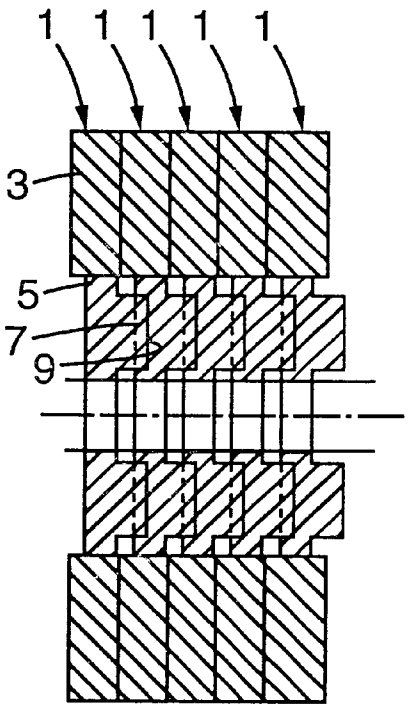
Figure 4A:
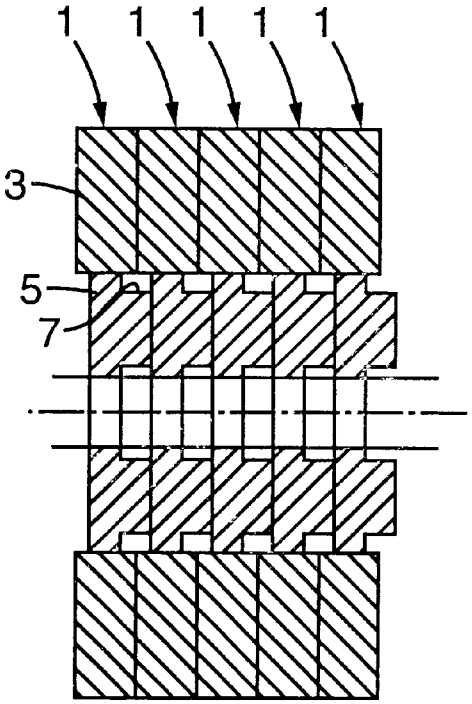

In one embodiment, as shown in FIG. 4(*a*), a predetermined number (five in FIG. 4(*a*)) of the abrasive brushes 1 (shown in cross-section as taken along line A—A of FIG. 1) are arranged so that the projecting part 7 (in the cross-section A—A, best shown in FIG. 2A) of the hub 5 of one abrasive brush 1 is brought into contact with a flat part 20 (in the cross-section A—A) which is neither the recessed part 9 nor the through-hole part 11 of the hub 5 of the adjacent abrasive brush 1, whereby the abrasive brushes are coupled together at a pitch (equal pitch) defined by the engagement relationship between the hubs to form an abrasive brush assembly. According to this embodiment, the brush sections 3 (abrasive material) are minimally compressed to result in the abrasive brush assembly having the widest width.

In a second embodiment, as shown in FIG. 4(*b*), a predetermined number of the abrasive brushes 1 (shown in cross-section as taken along line A—A of FIG. 1) are arranged so that the projecting part 7 (in the cross-section A—A) of the hub 5 of one abrasive brush 1 is inserted into the recessed part 9 (in the cross-section B—B, best shown in FIG. 2*b*) which is neither the through-hole part 11 nor the flat part 20 of the hub 5 of the adjacent abrasive brush 1, whereby the abrasive brushes are coupled together at a pitch (equal pitch) defined by the engagement relationship between the hubs to form an abrasive brush assembly. According to this embodiment, the brush sections 3 (abrasive material) are more compressed compared to FIG. 4(*a*) to result in the abrasive brush assembly with a width narrower by a predetermined amount than in the embodiment of FIG. 4(*a*).

In a third embodiment, as shown in FIG. 4(*c*), a predetermined number of the abrasive brushes 1 (shown in cross-section as taken along A—A of FIG. 1) are arranged so that the projecting part 7 (in the cross-section A—A, best shown in FIG. 2*a*) of the hub 5 of one abrasive brush 1 is inserted into the through-hole part 11 (in the cross-section C—C, best shown in FIG. 2*c*) which is neither the recessed part 9 nor the flat part 20 of the hub 5 of the adjacent abrasive brush 1 (so that the flat portions of the adjacent hubs are brought in contact with each other), whereby the abrasive brushes are coupled together at a pitch (equal pitch) defined by the engagement relationship between the hubs to form an abrasive brush assembly with a width narrower than the brush assembly illustrated in FIG. 4(*b*).

The present invention should not be limited to the above three embodiments, but includes various abrasive brush assemblies with different widths, and also having different brush surface hardness, by variously combining the projecting, recessed and through-hole parts of the assembly hubs.

It is also possible to form various abrasive brush assemblies with different overall width dimensions by providing in the hub 5 of the abrasive brush 1 a so-called concave (the recessed part 9 and the through-hole 11) and a so-called convex (the projecting part 7) and differentiating the engagement relationship between the concave and the convex when the abrasive brushes are adjacent to each other to form the brush assembly. By changing the overall width dimension of the brush sections, the compressive degree of the abrasive material, i.e., the brush surface hardness is also variable.

Since the hub provided in a central region (radial inner region) which ought to be required for a high compressive force in the prior art is formed of a solid member (which is not required to be compressed, in other words, which could be considered to have been compressed in advance to a predetermined dimension) and a portion necessary for being compressed during the process for superposing the abrasive brushes with each other is limited to the abrasive material section (radial outer region), a high compressive force (or installation) becomes unnecessary unlike the prior art. Thus, the customer at a job site can readily and quickly assemble a desired abrasive brush assembly.

An alternative abrasive brush of the present invention is described with reference to FIGS. 5 to 7 wherein parts and portions common to those of the brush illustrated in FIGS. 1–4 are denoted by the same reference numerals.

An abrasive brush 21 includes a brush section 3 and a hub 25. The hub 25 has a basic thickness, for example, approximately equal to half a thickness of the brush section 3 (radial outer abrasive material section) and is provided with a projecting part, recessed part and through-hole part. That is, in two cross-sections A–A' of the hub 25, a projecting part 27*a* extending parallel to the axial direction is provided on one side of the hub. On the other side of the radial inner section relative to the projecting part 27*a*, a recessed part 29*a* is provided, and a through-hole part 31*a* is provided in a further radial inner section, wherein the recessed part 29*a* is continuous to the through-hole part 31*a*. The projecting part 27*a*, the recessed part 29*a* and the through-hole part 31*a* are equi-distantly arranged at four positions on a predetermined diametrical circle on the one or other sides of the hub.

Similarly, in two cross-sections B–B' of the hub 25, a recessed part 29*b* is provided on one side, and a through-hole part 31*b* is provided in a further radial inner section, wherein the recessed part 29*b* is continuous to the through-hole part 31*b*. On the other side, a projecting part 27*b* extending parallel to the axial direction is provided in another radial inner section. The recessed part 29*b*, the through-hole 31*b* and the projecting part 27*b* are equi-distantly arranged at four positions on a predetermined diametrical circle.

Similarly, in two cross-sections C—C' of the hub 25, a through-hole part 31*c* is provided and a projecting part 27*c* is provided on one side of a further inner section, while a recessed part 29*c* is provided on the other side of a the inner section. The recessed part 29*c*, the through-hole part 31*c* and the projecting part 27*c* are equi-distantly arranged at four positions on a predetermined diametrical circle.

Each of the projecting parts 27*a* to 27*c* of the hub 25 have an approximately equal projected height and each of the recessed parts 29*a* to 29*c* has a depth approximately equal to half a projected height.

Figure 5:
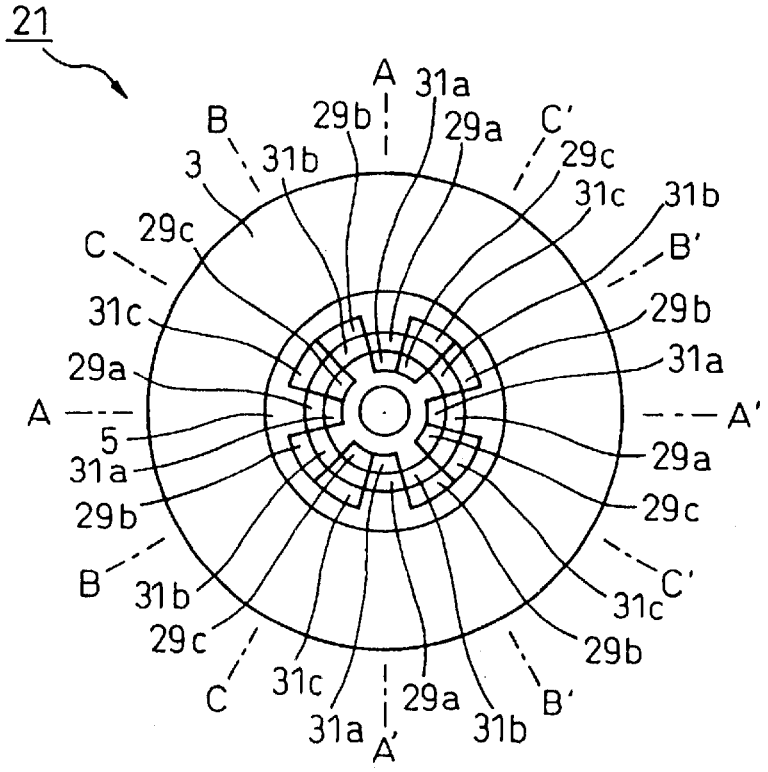
FIG. 5 is a plan view of one face of another abrasive brush of the present invention.
Figures 6A, 6B, 6C:
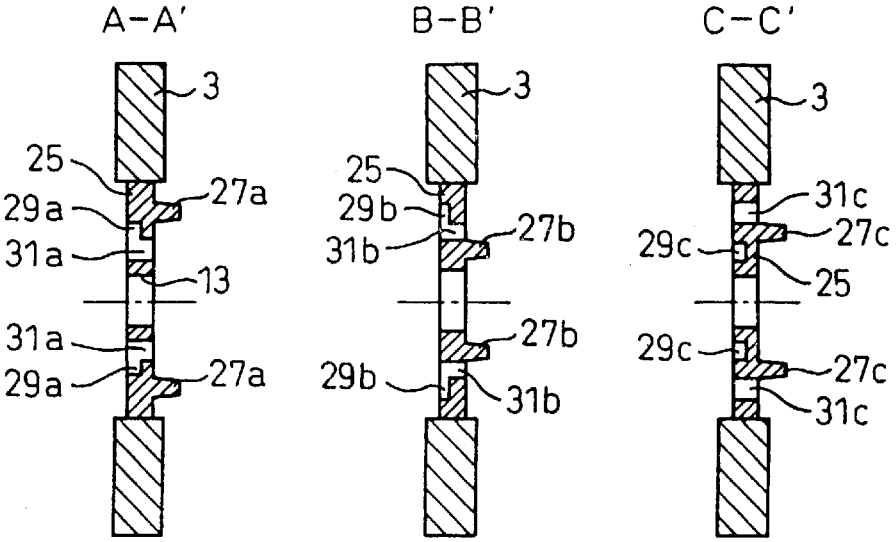
FIGS. 6(*a–c*) are cross-sectional views of the abrasive brush of FIG. 5 taken along section lines A–A', B—B' and C—C'.
Figure 7:
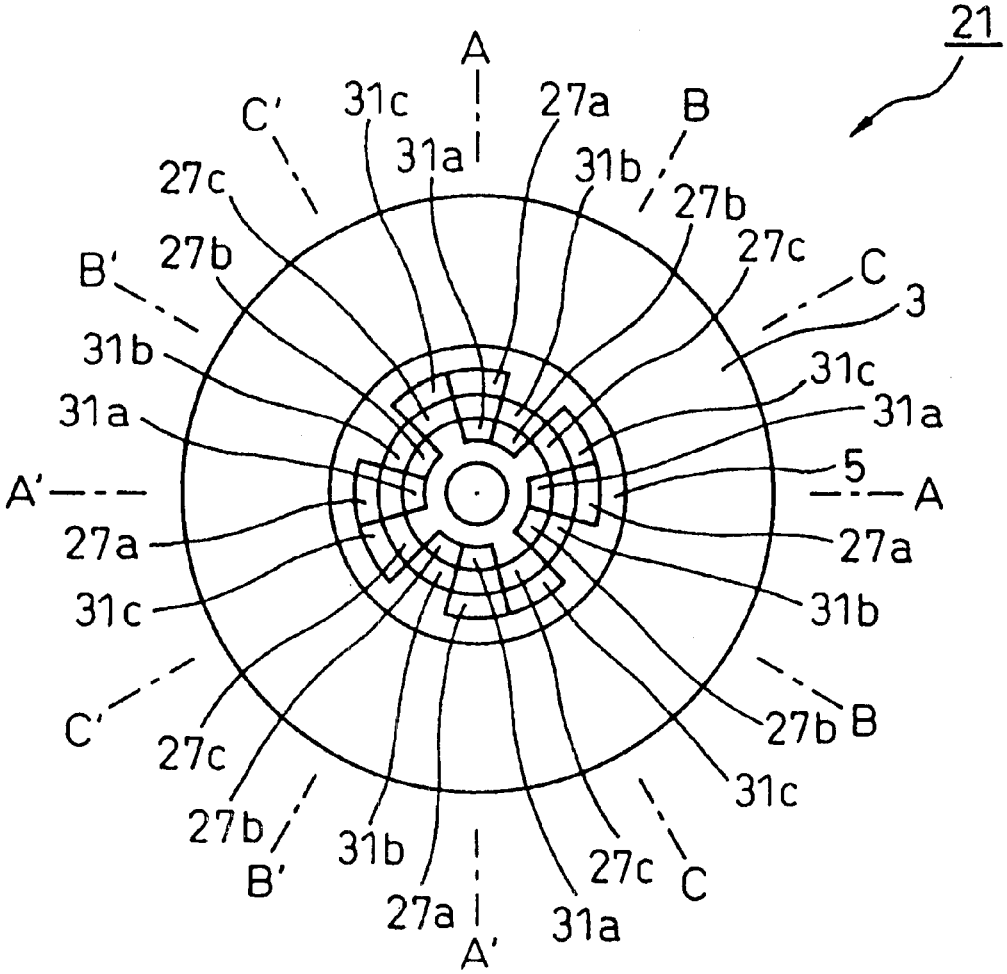
FIG. 7 is a plan view of another face of the abrasive brush of FIG. 5.

If a plurality of the abrasive brushes of the embodiment of FIGS. 5–7 are arranged adjacent to each other, it is possible to obtain various abrasive brush assemblies having different width dimensions as well as brush surface hardness in accordance with manner of assembly similar to those already described with reference to the embodiment of FIGS. 1–4.

Dimensions of the concave (the recessed part and the through-hole) and the convex features (the projecting part) may be individually determined in consideration of the strength of material constituting the hub or the magnitude of torque applied on the brush when used. Since the structure is such that the brush pitch is defined when the projecting part is in contact with the bottom of the recessed part, it is favorable that the concave/convex engagement is made with sufficient mutual clearance; particularly, the projecting part is preferably, for example, of a trapezoidal cross-sectional shape so that it is easily engageable with and/or guided into the mating recess part.

While the concave or the convex features are equi-distantly arranged at four positions on a predetermined diametrical circle in either of both the above-mentioned embodiments, the present invention should not be limited to only those embodiments. Unless a rotational balance becomes unstable, these features may be equi-distantly arranged optionally at N positions ($N \geqq 3$).

The through-hole provided at a center of the hub mainly serves for mounting the abrasive brush assembly on a rotary shaft, but may be used for the relative positioning and alignment of the brushes when they are superposed (assembled) with each other, or if necessary, another through-hole may be separately provided for this purpose.

Any material may be used for forming the hub provided it has suitable processability, including materials such as plastics or resins, metal and wood. Plastics or resins are preferred because they are processable using molding methods, dimensional, stable, and lightweight.

A flange may be attached to each of opposite sides of the brush to reduce a (so-called) blooming phenomenon of an outer peripheral edge of the brush.

The above-mentioned two embodiments are those typically applied to an abrasive brush assembly used for a large-sized grinder. The present invention, however, should not be limited to the application to such a large-sized device, but may be applied, for example, to a hand-held type grinder (a so-called straight grinder) not shown. That is, if the abrasive brush of the hand-held tool has the structure disclosed in the above-mentioned embodiments, it is possible to readily and quickly construct the abrasive brush assembly on site. Also, it is possible to obtain various brushes having different width dimensions by the simple angular positioning of adjacent hubs.

According to the present invention, a brush assembly having a desired width dimension and therefore a desired brush surface hardness can be extremely quickly, readily and simply constructed to provide a reasonable and economical abrasive brush.

What is claimed is:

1. An abrasive brush assembly comprising:

a plurality of abrasive brushes, each abrasive brush having a radial inner hub and a radial brush section, the hub being integrally formed with the brush section, the hub having a first radially extending face and a second radially extending face, the first face having a flat part and a recessed part and the second face having a projecting part, wherein the projecting part of the second face of each brush is adapted to selectively engage the first face of the hub of another brush.

2. The abrasive brush assembly of claim 1, wherein the plurality of abrasive brushes includes a first abrasive brush and a second abrasive brush and the projecting part of the hub of the first abrasive brush is selectively engageable with the flat part and recessed part of the hub of the second abrasive brush.

3. The abrasive brush assembly of claim 1, wherein the hub and brush sections are made of an injection molded plastic or resin.

4. The abrasive brush assembly of claim 1 wherein the hub of each brush has a through-hole extending from the first side of the hub to the second side of the hub.

5. The abrasive brush assembly of claim 4 wherein selectively engaging the projecting part of one brush with the flat part, the recessed part or through-hole of another brush allows the brushes to be spaced at selected distances.

6. A method for forming an adjustable width and hardness brasive brush assembly on a rotary shaft of a tool comprising:

disposing each of a first disk-shaped brush and a second disk-shaped brush onto the rotary shaft by extending the shaft through an attachment hole disposed centrally into each brush, wherein each brush includes opposite first and second radially extending faces, the second radially extending face of each brush including a projecting part extending generally parallel to the shaft; and engaging the projecting part from the first brush with the first face of the second brush.

7. The method claim 6, and further comprising:

disposing additional disk-shaped brushes adjacently onto the rotary shaft, each additional brush having substantially the same shape as the first brush and second brush; and engaging the projecting part on the second radially extending face of each additional brush with the first face of an adjacent brush.

8. The method of claim 6, and further comprising:

rotating the first brush with respect to the second brush such that the projecting part on the second radially extending face of the first brush engages a recess disposed in the first radially extending face of the second brush.

9. The method of claim 6, and further comprising:

rotating the first brush with respect to the second brush such that the projecting part on the second radially extending face of the first brush engages an aperture extending through the second brush.

10. The method of claim 6, and further comprising:

selectively rotating the first brush with respect to the second brush such that the projecting part on the second radially extending face of the first brush alternately engages the first face of the second brush, a recess disposed in the first face of the second brush and an aperture extending through the second brush.

11. An abrasive brush mountable on a rotary shaft of a tool comprising:

a disk-shaped hub including a central attachment hole therethrough, the attachment hole shaped so as to receive the rotary shaft, the hub including a first radially extending surface and a second radially extending surface:

a doughnut shaped abrasive brush section fixed on the radially outward perimeter of the hub, the abrasive brush section having a thickness greater than that of the hub;

a projecting part extending from the first radially extending surface in a direction generally parallel to the shaft; and a recess extending into the second radially extending surface in a direction generally parallel to the shaft.

12. The abrasive brush of claim 11, and further comprising:

an aperture disposed through the disk-shaped hub from the first radially extending surface to the second radially extending surface.

13. The abrasive brush of claim 12 wherein the projecting part, the recess and the aperture are disposed on the disk-shaped hub radially adjacent the attachment hole.

14. The abrasive brush of claim 13 wherein the projecting part, the recess and the aperture are concentrically and equally spaced about the hub.

15. The abrasive brush of claim 11, and further comprising:

a plurality of projecting parts extending from the first radially extending surface.

16. The abrasive brush of claim 11, and further comprising:

a plurality of recesses extending into the second radially extending surface.

17. The abrasive brush of claim 11, and further comprising:

a plurality of apertures disposed through the disk-shaped hub from the first radially extending surface to the second radially extending surface.

* * * * *

UNITED STATES PATENT AND TRADEMARK OFFICE

CERTIFICATE OF CORRECTION

PATENT NO. : 6,431,971 B2
DATED : August 13, 2002
INVENTOR(S) : Nagafuchi, Naohiro It is certified that error appears in the above-identified patent and that said Letters Patent is hereby corrected as shown below:

Column 1,
Line 29, "Kokia" should read -- Kokai --.

Column 6,
Line 15, "brasive" should read -- abrasive --.
Line 27, insert -- of -- after "method".

Signed and Sealed this

First Day of July, 2003

JAMES E. ROGAN
*Director of the United States Patent and Trademark Office*